US006819894B1

(12) United States Patent
Miller et al.

(10) Patent No.: US 6,819,894 B1
(45) Date of Patent: Nov. 16, 2004

(54) PIN AND BUSHING

(75) Inventors: Gregory P. Miller, Rochester, NY (US); Erwin Ruiz, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/721,838

(22) Filed: Nov. 25, 2003

(51) Int. Cl.[7] ..... G03G 15/00
(52) U.S. Cl. ..... 399/110; 399/113
(58) Field of Search ..... 399/110, 113, 399/114

(56) References Cited

U.S. PATENT DOCUMENTS 5,031,794 A * 7/1991 Wezenberg ..... 220/4.28

* cited by examiner

*Primary Examiner*—Quana Grainger
(74) *Attorney, Agent, or Firm*—Joseph M. Young

(57) ABSTRACT

An apparatus for connecting two devices includes a pin connected to a portion of a first device, the pin having first and second conical ends, and a bushing connected to a second device, the bushing having first and second sides and a perimeter. The bushing has an opening in its perimeter that is large enough to allow the pin and the portion of the first device connected thereto to pass completely through the bushing.

14 Claims, 4 Drawing Sheets

PIN AND BUSHING

The present invention relates to printing devices and more precisely to a method and apparatus for more easily removing a photoreceptor module therefrom.

Over the years, printing devices, like many technologies, have become more functional. At the same time, limited space in the workplace have increased the desire for devices that occupy less space (i.e., occupy a smaller footprint). Due to the twin constraints of increased functionality and limited space in the workplace, the internal components of printing devices are often densely packed inside the device. However, if a component requires servicing, it is still important to be able to access the appropriate component quickly. To further this end, internal components have been grouped into modules that can be more easily removed from and inserted into a device. For example, in some devices various components have been grouped into drawers that can be slid into and out of a device.

However, access to various components can still be time-consuming, as the ability to access various components is often still dependent upon moving or removing other components or modules within a device. In many cases, components are accessible on a last in-first out basis. Typically, one module will be inserted, then a second module. To remove the first module, the second module must be moved or removed first. It would useful to be able to access each module individually.

Further, the tolerances for spacing between different modules, in modern machines is often very tight. It is important that the relative positions of the modules remain constant. This can be true even when the machine is not in use. For example, there are tight spacing requirements between the fuser module and the photoreceptor belt on the photoreceptor module. It is important that the spacing between the two stay constant while the machine is in operation and during insertion and removal. Often, the fuser and the electrophotographic module (to which the photoreceptor module is mounted) were each separately connected to the frame of the device. However, tighter spacing within the machine has limited the freedom to locate a frame and to connect each component thereto. It would be desirable to be able to open either of these components independent of the other, without having to do any special operations.

The apparatus and method described herein can help assure that the distances between adjacent modules, particularly electrophotographic modules, remains within tolerances as one or the other is removed from or inserted into a printing device.

Embodiments include an apparatus for connecting two devices includes a pin connected to a portion of a first device, the pin having first and second conical ends, and a bushing connected to a second device, the bushing having first and second sides and a perimeter. The bushing has an opening in its perimeter that is large enough to allow the pin and the portion of the first device connected thereto to pass completely through the bushing.

Various exemplary embodiments will be described in detail, with reference to the following figures, wherein:

FIG. 4 shows a schematic front elevation view of an exemplary embodiment of a xerographic printing device 10.

Figure 4:
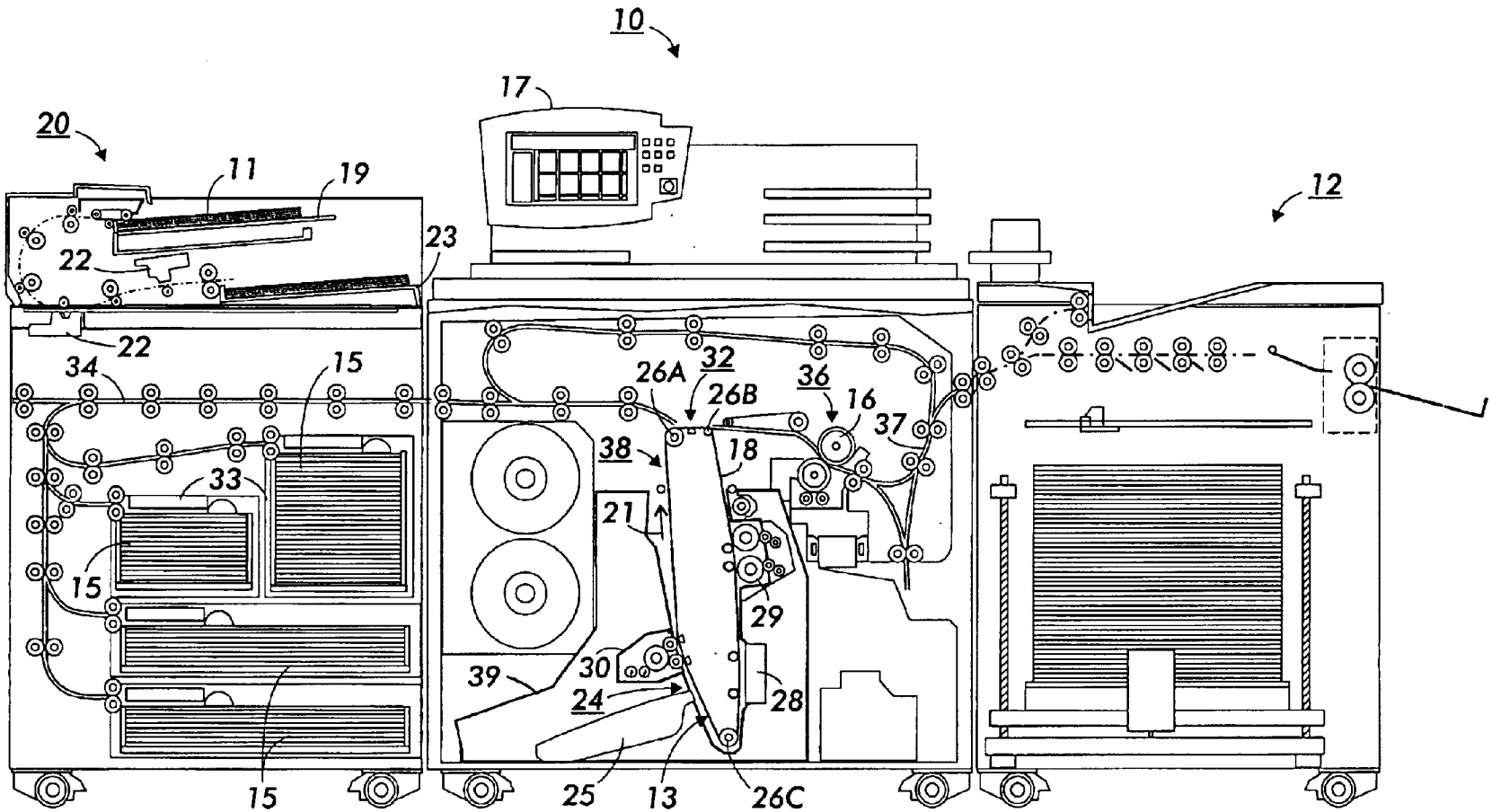
FIG. 4 is a schematic front elevation view of an exemplary embodiment of an electrophotographic device.

As in all xerographic machines, including the exemplary embodiment illustrated in FIG. 4, an image of an original document or set of documents 11 to be reproduced is projected or scanned onto a uniformly charged surface 13 of a photoreceptor 18 to form an electrostatic latent image thereon. Thereafter, the latent image is developed with an oppositely charged developing material called toner (not shown) to form a toner image, corresponding to the latent image on the photoreceptor surface. The toner image is then electrostatically transferred to a final support material or paper sheet 15, to which it may be permanently fixed by a fusing device 16.

In the illustrated printing device 10 of FIG. 4, a set of original documents 11 to be copied is placed on tray 19 of an automatic document handler 20. The machine operator enters the desired copying instructions, such as, for example, number of copies or sets of copies, through the control panel 17. The automatic document handler transports the documents 11 serially from the tray and past a scanning station 22 which scans each document, thereby producing digital image signals corresponding to the informational areas on the original document. Once scanned, the documents are deposited in an output tray 23. Additionally, information and instructions could come from a data storage medium or, if the printing device is connected to a network, they could come from a remote location such as a desktop computer.

The image signals are projected upon the uniformly charged surface of the photoreceptor at an imaging station 24 by a raster output system 25 to form a latent electrostatic image of the scanned informational areas of the original document thereon as the photoreceptor is moved passed the imaging station. The photoreceptor 18 is in the form of a flexible, endless belt 18 having a photoconductive outer surface 13 and is mounted on a photoreceptor module 38. The belt 18 is supported by a set of rollers 26A, 26B, 26C and a plurality of backing members located opposite various stations. At least one of the rollers 26A is driven to move the photoreceptor belt 18 in the direction indicated by arrow 21 at a constant rate of speed about the rollers and past the various xerographic processing stations. Before entering the imaging station 24, a charging station 28 uniformly charges the photoreceptor surface 13. The exposure of the charged surface of the photoreceptor to the digital signals at the imaging station discharges the photoreceptor surface in the areas struck by the digital image signals. Thus, there remains on the photoreceptor surface a latent electrostatic image in image configuration corresponding to the informational areas on the original. As the photoreceptor continues its movement, the latent electrostatic image thereon passes through developing station 30 where oppositely charged toner is deposited on the latent electrostatic image to form a toner image.

The photoreceptor movement continues transporting the toner image from the developer station to a transfer station 32. A paper supply 33 feeds a sheet 15 to a sheet transport 34 for travel to the transfer station. The sheet moves into aligned and registered contact with the toner image at a speed synchronistic with the moving photoreceptor. Transfer of the toner image to the sheet is effected and the sheet with the toner image is stripped from the photoreceptor and conveyed to a fusing station 36 having fuser device 16 where the toner image is fused to permanently fix the toner image to the sheet. After the toner image is fixed to the sheet, the sheet is transported by sheet transporting mechanism 37 to a finishing station 12 where the sheets with the permanent images thereon may be compiled into sets of sheets and finished by being stapled, bound, or the like.

Suitable drive means (not shown) for the document creating apparatus are arranged to drive the photoreceptor in timed relationship to the scanning of the original document and forming the latent electrostatic image on the photoreceptor, to effect development of the latent electrostatic image, to separate and feed sheets of paper, to transport same through the transfer station in time registration with the toner image, and to convey the sheet of paper with the toner image through the fusing station to fix the toner image thereto in a timed sequence to produce copies of the original documents.

Figure 1:
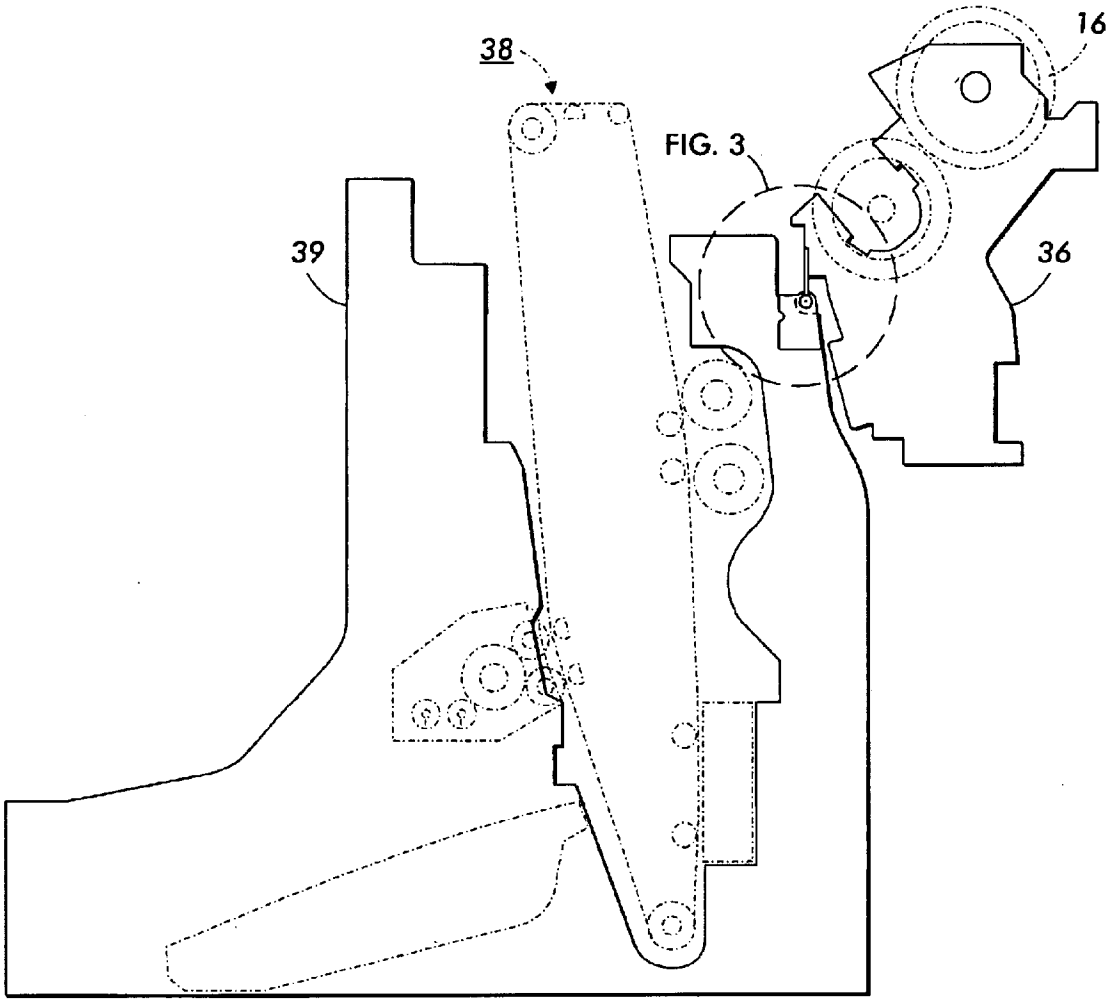
FIG. 1 is a schematic front elevation view of exemplary embodiments of an electrophotographic module and a fuser station.
Figure 2:
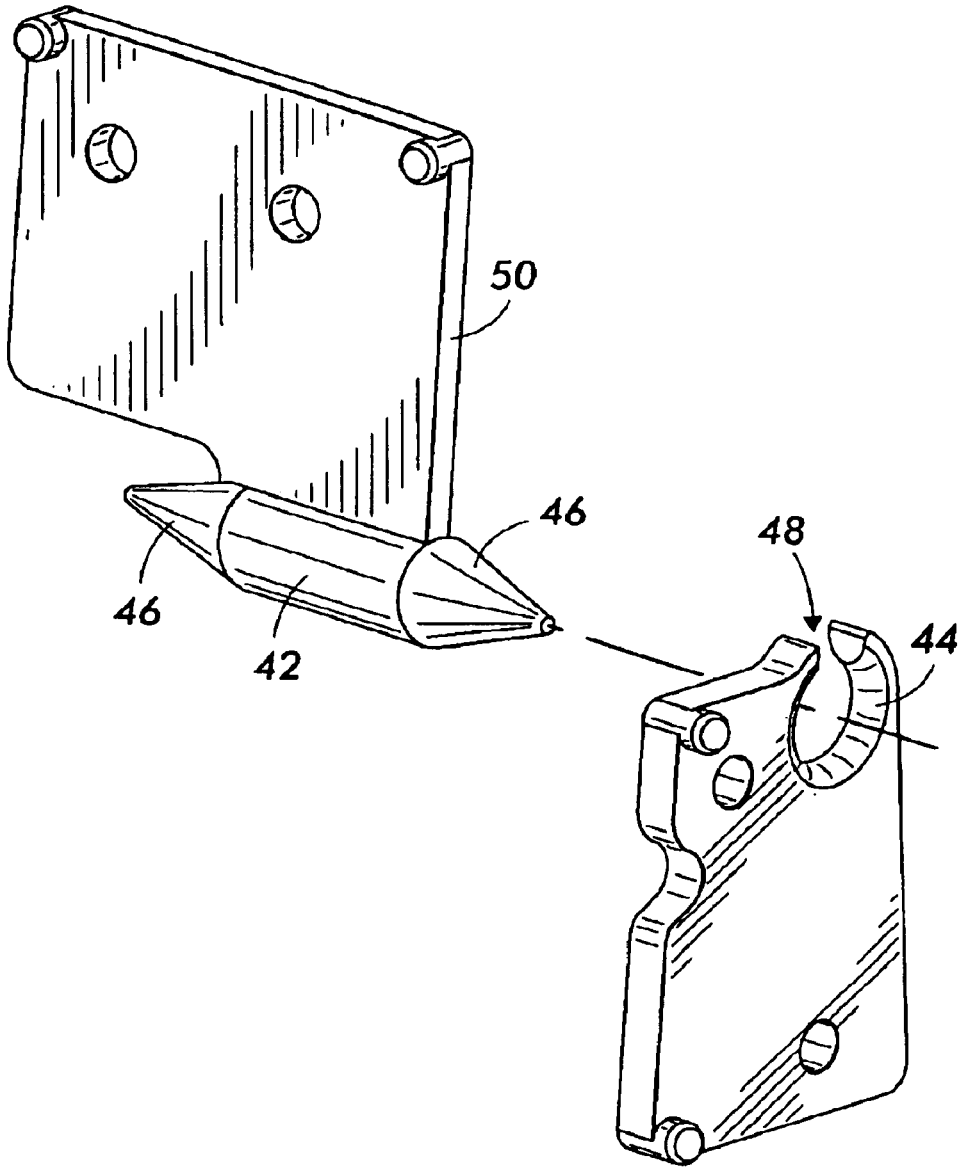
FIG. 2 is a schematic perspective view of an exemplary embodiment of a pin and bushing.
Figure 3:
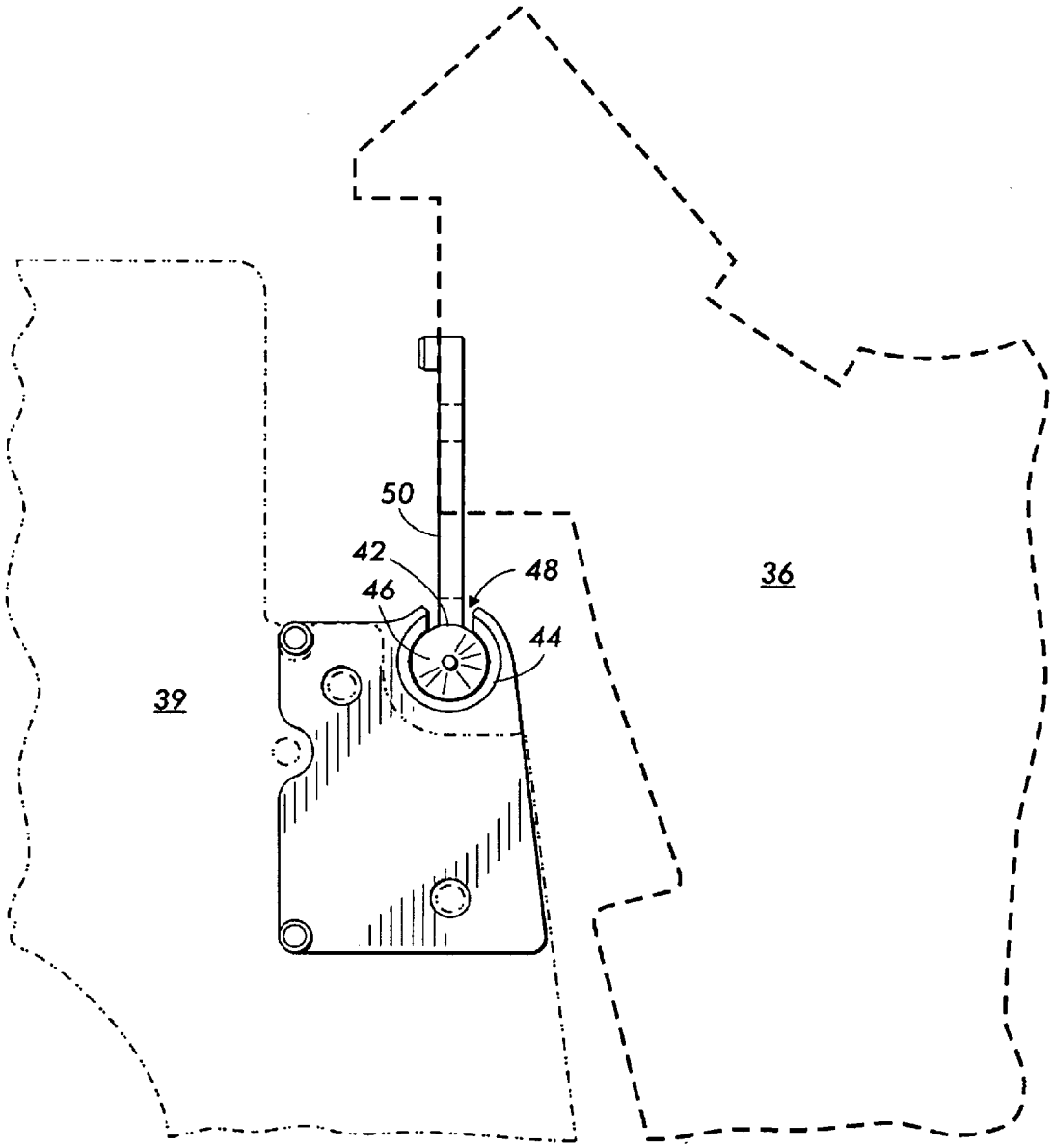
FIG. 3 is a blown up view of the electrophotographic module and the fuser station of FIG. 1, illustrating the link between them in more detail.

The foregoing description is believed to be sufficient for the purposes of showing the general operation of document creating apparatus. FIGS. 1–3 illustrate an exemplary embodiment of the photoreceptor module 38 in greater detail.

In the electrophotographic device 10 illustrated in FIG. 4, various electrophotographic components are included in one drawer 39 that slides in and out through the front panel. In embodiments, such as that shown in FIGS. 1 and 3, the electrophotographic drawer 39 mounts approximately 75% of the electrophotographic components. FIG. 1 illustrates an exemplary embodiment of a larger view of the drawer 39. While the electrophotographic drawer 39 will be shown and described as passing through the front panel, it could just as easily be removable through any of the other panels. The electrophotographic drawer 39 is also designed to receive a photoreceptor module drawer 38.

To provide strength and accurate locating of components within the printing device 10, some or all of the wall panels of the printing device 10 are generally provided with a frame. Space for a frame is limited in the front panel due to the modules being inserted and removed through it. However, multiple internal components need to be connected to the frame for both support and the accurate positioning of components within the printing device 10, both relative to each other and to the printing device 10 itself. For example, both the fuser station 36 and the electrophotographic module 39 are usually connected to the front panel frame (not illustrated). In embodiments, the electrophotographic module drawer 39 is connected to the frame along the lower outboard (front) panel and to the inboard panel. It is located with two pins into the frame along the inboard (rear) panel.

FIG. 1 also shows an enlarged view of the fuser station 36. The fuser station 36 is also connected to the frame of the printing device 10. Similar to the electrophotographic module, the fuser station can also be incorporated into a drawer to ease removal from and insertion into the printing device 10.

There is a very tight locational requirement between the photoreceptor module, which is in the electrophotographic drawer. Both drawers will typically require servicing by either customer service representatives or by specially trained customers.

The electrophotographic module 39 and fusing station 36 each incorporate multiple features. However, the exact details of either are not important to the present invention.

In the past, the fuser station 36 and the electrophotographic module 39 (to which the photoreceptor module 38 is mounted) were each separately connected to the frame of the printing device. The fuser station 36 needs to be a particular distance from the electrophotographic module 39 to within a limited range of distances. Therefore, not only should each of them be connected to the frame, they should also be connected to each other. However, using most methods of connecting the two devices usually meant that access to one or the other was limited. In the dense interior of modern machines, it was often difficult to remove each of them independent of the other. Usually, at least one of them could not be readily accessed without removing the other first.

To ease access to more components within the printing device 10, a particular pin 42 and a particular bushing 44 have been used. Specifically, they are described in the context of connecting the fuser station 36 to the electrophotographic module 39. Using the distinctive pin 42 and bushing 44 described herein, the user may remove either of the fuser station 36 or the electrophotographic module 39 without disturbing the other.

The distinctive pin 42 (see FIG. 2) is substantially cylindrical with two substantially conical ends 46. In embodiments, the pin has no head or flange portion. In FIG. 2, the pin 42 is connected to a portion of the fuser station 36 lengthwise along its outer edge and the bushing 44 is molded into the electrophotographic module 39. When both the fuser station 36 and the electrophotographic module 39 are in place within the printing device 10, the pin engages the bushing, thereby locating the fuser station 36 relative to the electrophotographic module 39. FIG. 3 shows the link between the fuser station 36 and the electrophotographic module 39 in more detail. An end 46 of the pin 42 can be seen extending out through the bushing 44 in FIG. 3.

The bushing 44 has a radial lead-in on both sides to allow for axial misalignment between the fuser station 36 and the electrophotographic module 39. The fuser station 36 has a small degree of freedom in which to move so that it can align with both the electrophotographic module and the frame. The electrophotographic module drawer 39 is heavier and less movable than the fuser station 36. Therefore, the fuser station typically adjusts its position slightly. The radial lead-in helps the fuser station self locate itself relative to the photoreceptor module (when it is in position within the electrophotographic module 39) as well as the frame. This self-locating feature helps enable very tight locational tolerancing of each device to the other.

Further, when situated in the printing device 10, the fuser station 36 and the electrophotographic module 39 are pinned directly to each other as well as the machine frame. The link provides added support for each other as well as to the frame of the printing device 10. Their combined strength is additive to that of the printing device's frame. Also, machine deflections can play havoc with tolerances. By pinning together these two subsystems, they deflect together, thereby reducing the risk that the distance between the fuser module and the photoreceptor module will end up beyond tolerance.

Conventional pin and bushing locators, while being accurate, require the last system closed to be the first opened (if pinning system to system). To help allow removal of either the fuser station or the electrophotographic module, the bushing 44 has an opening 48 in a portion of its perimeter that is wide enough to pass the edge 50 of the fuser station connected to the pin 42. The pin 42 has also been made with dual conical ends 46. Between the ends 46 of the pin 42 and the opening 48 in the bushing 44, each sub-system can be opened completely independent of the other. One can remove either the electrophotographic module drawer 39 or the fuser station 36, regardless of which was inserted first.

The pin 42 and bushing 44 should be relatively strong to support both the fuser station 36 and the electrophotographic module 39. Depending upon the particular application these two parts can be made of a variety of materials. For example, the pin 42 and bushing 44 can be made of molded powdered metal. Potential examples include a pin made of powdered bronze, and a bushing made of powdered steel. It may also be possible to have one or both of the pin 42 and bushing 44 molded from plastic.

In the illustrated embodiments, the pin 42 is connected to the fuser station 36 lengthwise along its outer edge and the bushing 44 is molded into the electrophotographic module 39. The positions of these components could be reversed, with the pin connected lengthwise to an edge of the electrophotographic module 39 and the bushing connected to the fuser station 36.

The method for aligning and supporting devices disclosed herein and the particular pin and bushing used can of course be used to hold components in complex devices other than xerographic printers together. Other non-xerographic printers having multiple internal components likely have or will have similar access problems. There is no reason why the method and apparatus disclosed herein could not be used to benefit them as well.

While the present invention has been described with reference to specific embodiments thereof, it will be understood that it is not intended to limit the invention to these embodiments. It is intended to encompass alternatives, modifications, and equivalents, including substantial equivalents, similar equivalents, and the like, as may be included within the spirit and scope of the invention.

What is claimed is:

1. An apparatus for linking two devices, comprising:

a pin connected to a portion of a first device, the pin having first and second conical ends; and a bushing connected to a second device, the bushing having first and second sides and a perimeter, wherein the bushing has an opening in its perimeter, and wherein the opening is large enough to allow the pin and the portion of the first device connected thereto to pass completely through the bushing.

2. The apparatus of claim 1, wherein the perimeter of the bushing has a radial lead-in on both sides.

3. The apparatus of claim 1, wherein at least one of the pin and the bushing is made of powdered metal.

4. The apparatus of claim 1, wherein at least one of the pin and the bushing is made of plastic.

5. An printing device comprising:

a first module;

a second module;

a means for connecting the two modules such that each module may be completely removed independent of the other.

6. The device of claim 5, wherein the first module is an electrophotographic module.

7. The device of claim 6, wherein the second module is a fuser station.

8. The device of claim 7, wherein the electrophotographic module is incorporated into a first drawer and the fuser station is incorporated into a second drawer.

9. A printing device, comprising:

a first module;

a pin connected to a portion of the first module, the pin having first and second conical ends;

a second module;

a bushing connected to the second module, the bushing having first and second sides and a perimeter, wherein the bushing has an opening in its perimeter, and wherein the opening is large enough to allow the pin and the portion of the first module connected thereto to pass completely through the bushing.

10. The device of claim 9, wherein the first module is an electrophotographic module.

11. The device of claim 10, wherein the second module is a fuser station.

12. The device of claim 9, wherein the perimeter of the bushing has a radial lead-in on both sides.

13. The device of claim 9, wherein at least one of the pin and the bushing is made of powdered metal.

14. The device of claim 9, wherein at least one of the pin and the bushing is made of plastic.

* * * * *